US011111642B2

(12) United States Patent
Creaven et al.

(10) Patent No.: US 11,111,642 B2
(45) Date of Patent: Sep. 7, 2021

(54) VEHICLE STOPPING DEVICE

(71) Applicants: Thomas F Creaven, London (GB); Franco S De Liguori, Lutz, FL (US)

(72) Inventors: Thomas F Creaven, London (GB); Franco S De Liguori, Lutz, FL (US)

( * ) Notice: Subject to any disclaimer, the term of this patent is extended or adjusted under 35 U.S.C. 154(b) by 31 days.

(21) Appl. No.: 16/505,232

(22) Filed: Jul. 8, 2019

(65) Prior Publication Data

US 2021/0010215 A1 Jan. 14, 2021

(51) Int. Cl.
*E01F 13/12* (2006.01)
*F41H 11/08* (2006.01)
*E01F 13/06* (2006.01)

(52) U.S. Cl.
CPC ..... *E01F 13/12* (2013.01); *E01F 13/06* (2013.01); *F41H 11/08* (2013.01)

(58) Field of Classification Search
CPC ..... E01F 13/12
See application file for complete search history.

(56) References Cited

U.S. PATENT DOCUMENTS 5,536,109 A * 7/1996 Lowndes ..... E01F 13/04 256/1
5,871,300 A * 2/1999 Ingham ..... E01F 13/12 404/6
6,527,475 B1 * 3/2003 Lowrie ..... E01F 13/12 180/287
6,623,205 B1 * 9/2003 Ramirez ..... E01F 13/12 404/6
6,749,362 B1 * 6/2004 Eichenberg ..... E01F 13/12 404/6
6,994,488 B2 * 2/2006 Crowley, Sr. ..... E01F 13/12 404/6
7,186,052 B2 * 3/2007 Rom ..... B60R 25/09 404/6
7,275,889 B1 * 10/2007 McGill ..... E01F 13/12 404/6
7,850,392 B2 * 12/2010 Schubert ..... E01F 13/12 404/6

(Continued)

FOREIGN PATENT DOCUMENTS

DE 593355 C * 2/1934 ..... E01F 13/12
FR 784754 A * 7/1935 ..... F41H 11/08
GB 577929 A * 6/1946 ..... F41H 11/08

*Primary Examiner* — Thomas B Will
*Assistant Examiner* — Katherine J Chu
(74) *Attorney, Agent, or Firm* — DP IP Group; Franco S. De Liguori

(57) ABSTRACT

A vehicle stopping device includes a casing configured as an open enclosure having an open side, vertical side walls, a horizontal top wall and a horizontal bottom wall forming an interior space of the open enclosure. A pair of caltrop bars are configured to be securely stored within the interior space of the casing in a stored position, and are configured to be activated from the stored position to a deployed position in which the first and second caltrop bars extend out of the interior space of the casing through the open side thereof for positioning on opposite sides of a vehicle tire. Each of the caltrop bars being formed of a bar and one or more caltrops arranged along the bar for puncturing and deflating the vehicle tire when the vehicle tire is driven over the caltrop bars.

7 Claims, 21 Drawing Sheets

(56) References Cited

U.S. PATENT DOCUMENTS

| | | | | |
|---|---|---|---|---|
| 8,231,303 | B1 * | 7/2012 | Bowen | F41H 11/08 404/6 |
| 8,506,203 | B2 * | 8/2013 | Spencer | E01F 13/12 404/6 |
| 8,858,113 | B1 * | 10/2014 | Bettendorf | E01F 13/12 404/6 |
| 9,297,128 | B1 * | 3/2016 | Tang | E01F 13/12 |
| 10,106,940 | B1 * | 10/2018 | Tang | E01F 13/12 |
| 10,408,557 | B2 * | 9/2019 | Verdino | F41B 3/02 |
| 10,662,596 | B2 * | 5/2020 | Barbrey | E01F 13/12 |
| 2005/0147466 | A1 * | 7/2005 | Crowley, Sr. | E01F 13/12 404/73 |
| 2011/0135385 | A1 * | 6/2011 | Washington | E01F 13/12 404/6 |

* cited by examiner

VEHICLE STOPPING DEVICE

BACKGROUND

Technical Field

The present disclosure relates generally to law enforcement, and more particularly to devices of the type employed by law enforcement to incentivize a driver of a vehicle to comply with law enforcement instructions and not attempt to flee. The devices of the present disclosure are configured to immobilize the vehicle in situations where drivers attempt to flee.

Background Information

The police, other law enforcement agencies and even military personnel from time to time are involved in high speed pursuits which are dangerous and potentially life threatening for those involved, innocent people whether pedestrians or other motorists in the path of the fleeing vehicle. Devastating consequences can occur for people including loss of life and hugely damaging to property. A high-speed pursuit can involve many police resources; cars, helicopters etc. which is extremely expensive for law enforcement.

A proportion of high-speed pursuits start with a vehicle that is stationary. Maybe an officer has pulled over a vehicle on the highway or a vehicle may be under surveillance. The driver, for whatever reason, decides that they need to flee the scene and the high-speed chase begins.

Classic police roadblock by which law enforcement cars are parked across a roadway and/or around a vehicle that has been pulled over often results in blockage of all vehicular traffic and thereby often causes congestion of citizen drivers at the roadblock who must either be allowed to pass by movement of law enforcement cars or risk physical harm in any subsequent confrontation between law enforcement and driver of a fleeting vehicle. In other words, classic law enforcement roadblocks are non-selective, cause congestion and often result in more injury than they are worth.

Tire deflation devices have been developed that are deployed by an officer placing themselves in danger in the path of an oncoming vehicle that could be being driven by an individual in a 'highly emotional/adrenaline charged' state caused by; having just committed a crime, having consumed alcohol, drugs, being emotionally charged because of conflicts with other motorists, relatives, wives, ex-wives, husbands etc. Such devices typically include a base and a plurality of tire deflating spikes secured to the base. When a tire of a vehicle rolls over the device, the spikes are embedded in the tire, causing the tire to deflate, thus immobilizing the vehicle.

The tire deflation devices of the type described above suffer from various problems because of their non-selectivity and requirement for timely deployment and removal upon a roadway. Furthermore, such tire deflation devices are generally single use devices. That is, once a vehicle has run over the device, the device is generally not reusable.

Accordingly, it is one object of the present disclosure to provide a vehicle stopping device which can be easily and rapidly deployed and removed after use.

As another object of the vehicle stopping device according to the present disclosure, whilst the vehicle is stationary it can be immobilised quickly and easily with almost no risk to an officer's life and limb and in such a way as once deployed there will now be almost no chance of a high-speed pursuit.

Yet another object of the present disclosure is to provide a vehicle stopping device designed to be deployed by a single operator in a matter of seconds.

Still another object of the present disclosure is to provide a multiple use vehicle stopping device allowing law enforcement to get multiple usages out of a single device, and therefore reducing the effective cost of the device to law enforcement.

The foregoing objects, among others, are achieved by the vehicle stopping device of the present disclosure.

SUMMARY

The present disclosure provides a vehicle stopping device for law enforcement and military personnel. In an exemplary embodiment, the vehicle stopping device includes a casing or housing providing an open enclosure with an open side, vertical side walls, a horizontal top wall and a horizontal bottom wall forming an interior space of the open enclosure. Two (first and second) hinge mechanisms are securely positioned with the interior space of the casing. A first caltrop bar has a first end connected to the first hinge mechanism and a second, free end. A second caltrop bar has a first end connected to the second hinge mechanism and a second, free end. Each of the first and second caltrop bars is formed of a bar and one or more caltrops arranged along the bar. The first and second caltrop bars are configured to be securely stored within the interior space of the casing in a stored position and to be activated from the stored position to a deployed position in which the first and second caltrop bars extend out of the interior space of the casing through the open side thereof. In the deployed position, the first and second caltrop bars are configured to be positioned on opposite sides of a vehicle tire as defined by the tire width (i.e., to provide coverage along the width of the vehicle tire).

At least one handle is provided on the horizontal top wall of the casing for carrying the vehicle stopping device in both the stored and deployed positions of the first and second caltrop bars. Alternatively, the at least one handle comprises two handles provided on the horizontal top wall of the casing in spaced-apart relation to one another.

In one embodiment, the first and second hinge mechanisms are configured to permit the first and second caltrop bars to be manually displaced from the stored position to the deployed position.

In an exemplary embodiment, the vehicle stopping device includes a lock and release mechanism for releasing the first and second caltrop bars from the stored position to the deployed position. In this embodiment, the first and second hinge mechanisms are configured to bias the respective first and second caltrop bars towards the deployed position. Upon activation of the release mechanism, the first and second caltrop bars are automatically released from the stored position to the deployed position.

In another exemplary embodiments, the lock and release mechanism comprises a cam lock provided at the first end of each of the first and second caltrop bars. For each of the first and second caltrop bars, the cam lock is configured to be placed in a locked position in which the cam lock hooks over a portion of the caltrop bar at the free end thereof so that the caltrop bar is maintained in the stored position. The cam locks are also configured to be unlocked (i.e., the cam lock does not hook over portions of the caltrop bars) to automatically release the caltrop bars to the deployed position.

In another exemplary embodiment, the lock and release mechanism comprises an elongate member having a main portion and two bar portions extending from the main portion in spaced-apart relation from one another. The elongate member is configured to be placed in a locked position in which the bar portions are configured to extend through respective slots formed in the horizontal top wall of the casing and into respective pairs of aligned receptacles positioned in the interior space of the casing to securely hold the first and second caltrop bars in the stored position. The elongate member is also configured to be unlocked by removing the bar portions from the aligned receptacles and out of the interior space of the casing to automatically release the caltrop bars to the deployed position.

In the foregoing exemplary embodiments of the lock and release mechanism, the elongate member may be a police night stick style device that is connected to the casing via a quick release connector so that the device may be readily disconnected from the casing by the user (e.g., law enforcement personnel) for self-defense and to maintain order as needed.

The vehicle stopping device according to any of the foregoing embodiments may be further fitted with a safety cover that covers the open side of the casing. The safety cover is configured to permit the first and second caltrop bars to be released to the deployed position without necessitating removal of the safety cover.

In the foregoing embodiments, in the deployed position the caltrop bars are configured to be disposed at a preselected angle of generally 90 degrees relative to the casing. Alternatively, the caltrop bars can be configured to be deployed at preselected angles less than or greater than 90 degrees relative to the casing, depending on the position of the vehicle tire during use of the vehicle stopping device.

In one example of the vehicle stopping device according to any of the foregoing embodiments, the one or more caltrops are fixedly mounted (e.g., welded) along the bar. In another example, the one or more caltrops are arranged along the bar on spaced roller bearings.

In the vehicle stopping device according to any of the foregoing embodiments, the one or more caltrops may have a hollow construction and/or be provided with blades to facilitate and expedite the escape of compressed air and/or immobilization of the vehicle tire should the vehicle be moved while the vehicle stopping device is applied to the vehicle tire. In another embodiment, the one or more caltrops may be further provided with at least one barbell-shaped tip to prevent the caltrop from coming out of the vehicle tire after penetrating the vehicle tire.

According to the present disclosure, the vehicle stopping devices are of the type employed by law enforcement to incentivize a driver of a vehicle to comply with law enforcement instructions and not attempt to flee. The devices of the present disclosure are configured to immobilize the vehicle in situations where drivers attempt to flee. As a result, the vehicle stopping devices of the present disclosure effectively act as devices to deter vehicle drivers from fleeing law enforcement.

BRIEF DESCRIPTION OF THE DRAWINGS

These and other features, aspects and advantages of the present disclosure will become better understood with regard to the following description, appended claims and accompanying drawings wherein:

DETAILED DESCRIPTION OF THE DISCLOSURE

Figure 1:
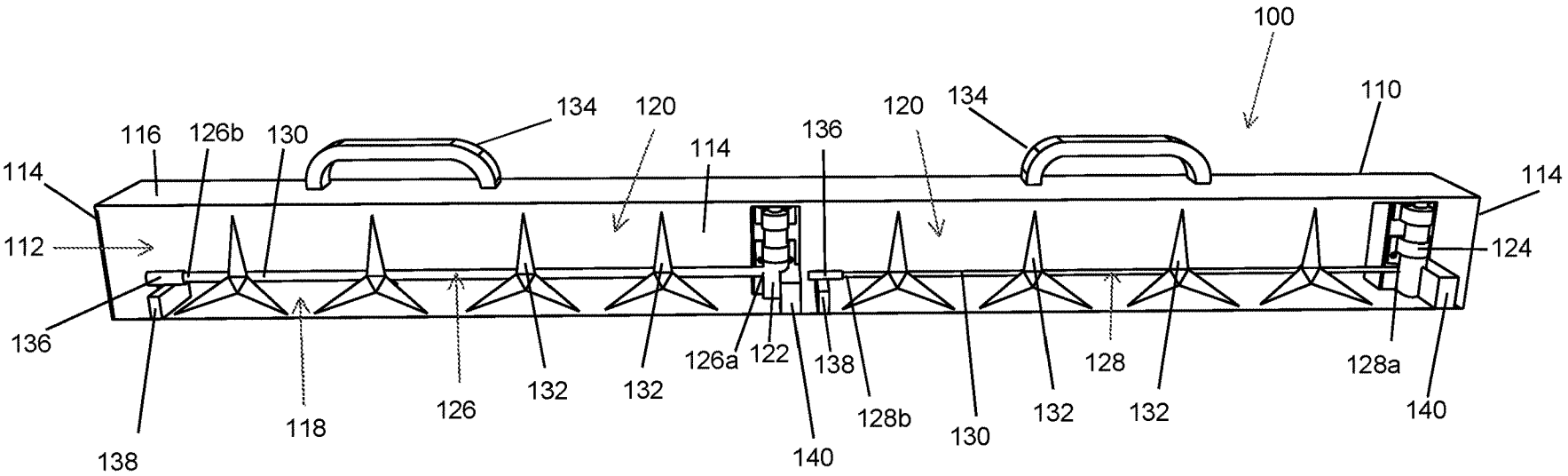
FIG. 1 is a front elevational view of a vehicle stopping device according to a first embodiment of the present disclosure.

The foregoing summary, as well as the following detailed description of preferred embodiments of the disclosure, will be better understood when read in conjunction with the accompanying drawings. For the purpose of illustrating the various aspects of the vehicle stopping device of the present disclosure, there is shown in the drawings embodiments which are presently preferred. It should be understood, however, that the various aspects of the vehicle stopping device of the present disclosure is not limited to the precise arrangement and instrumentalities shown.

The word "exemplary" is used herein to mean "serving as an example, instance, or illustration." Any embodiment described herein as "exemplary" is not necessarily to be construed as preferred or advantageous over other embodiments. The images in the drawings are simplified for illustrative purposes and are not depicted to scale. To facilitate understanding, identical reference numerals have been used, where possible, to designate identical elements that are common to the figures, except that suffixes may be added, when appropriate, to differentiate such elements.

FIG. 1 shows a vehicle stopping device, generally designated at 100, according to one embodiment of the present disclosure. Device 100 includes a casing or housing 110 providing an open enclosure formed of an open side 112, vertical side walls 114, a horizontal top wall 116 and a horizontal bottom wall 118 forming an interior space 120 of the open enclosure. Two (first and second) hinge mechanisms 122, 124 are securely positioned with interior space 120 of casing 110. A first caltrop bar 126 has a first end 126*a* connected to first hinge mechanism 122 and a second, free end 126*b*. A second caltrop bar 128 has a first end 128*a* connected to second hinge mechanism 124 and a second, free end 128*b*. Each of first and second caltrop bars 126, 128 is formed of a bar 130 and one or more caltrops 132 arranged along bar 130. First and second caltrop bars 126, 128 are configured to be securely stored within interior space 120 of casing 110 in a stored position and to be activated from the stored position to a deployed position in which first and second caltrop bars 126, 128 extend out of interior space 120 of casing 110 through open side 112 thereof. In the deployed position, first and second caltrop bars 126, 128 are configured to be positioned on opposite sides of a vehicle tire (FIG. 16) as defined by the tire width (i.e., to provide coverage along the width of the vehicle tire).

At least one handle 134 is provided on horizontal top wall 116 of casing 110 for carrying vehicle stopping device 100 in both the stored and deployed positions of first and second caltrop bars 126, 128. In this embodiment, two handles 134 are provided on horizontal top wall 116 in spaced-apart relation to one another as shown in FIG. 1.

In the embodiment shown in FIG. 1, each of first and second hinge mechanisms 122, 124 is a free running hinge configured to permit first and second caltrop bars 126, 128, respectively, to be manually displaced from the stored position to the deployed position.

Figure 2:
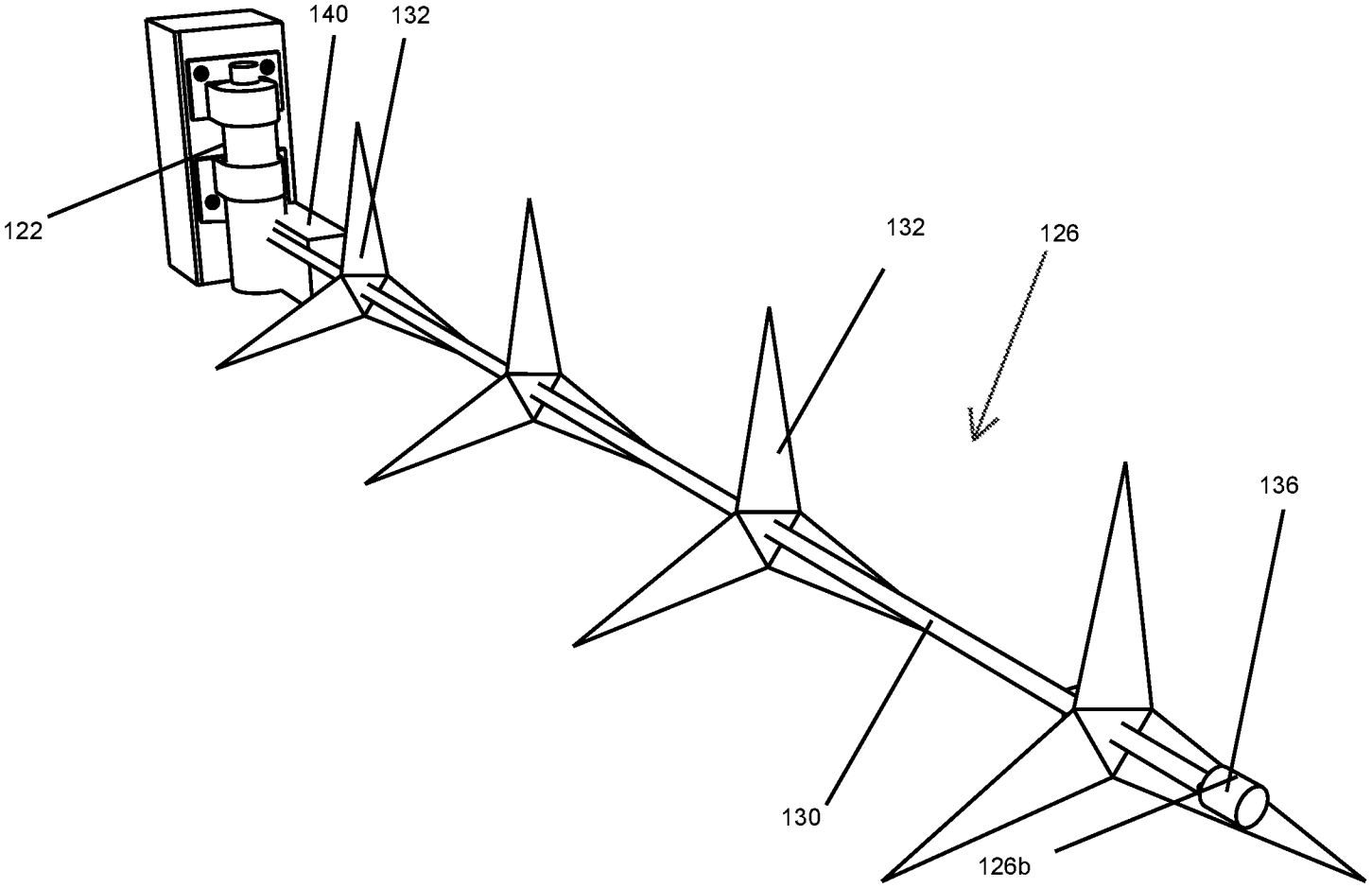
FIG. 2 is a perspective view of one embodiment of a caltrop bar and hinge mechanism for the vehicle stopping device of the present disclosure.

FIG. 2 is a perspective view of caltrop bar 126 shown in FIG. 1. This is a close-up view to better illustrate the construction of the caltrop bar, including bar 130 and caltrops 132, and its manner of connection to hinge mechanism 122.

According to a feature of the present embodiment, an end stop 136 is provided at free end 126*b* of caltrop bar 126 for engagement with a runner element 138 (FIG. 1) provided in inside interior space 120 of casing 110 to ensure a smooth deployment of caltrop bar 126 to the deployed position. Specifically, the engagement between end stop 136 and runner element 138 holds caltrop bar 126 off horizontal bottom wall 118 of casing 110 to prevent snagging upon deployment. Although not shown in close-up view, caltrop bar 128 connected to hinge mechanism 124 has the same construction and functions as caltrop 126 described above with reference to FIG. 2.

According to another feature of the present embodiment, a stop block 140 extends from each of hinge mechanisms 122, 124 at an angle of generally 90 degrees (FIG. 1) to ensure that caltrop bars 126, 128 extend at an angle of generally 90 degrees from casing 110 in the deployed position.

FIGS. 3-10 show another embodiment of a vehicle stopping device, generally designated at 200, according to the present disclosure.

Figure 3:
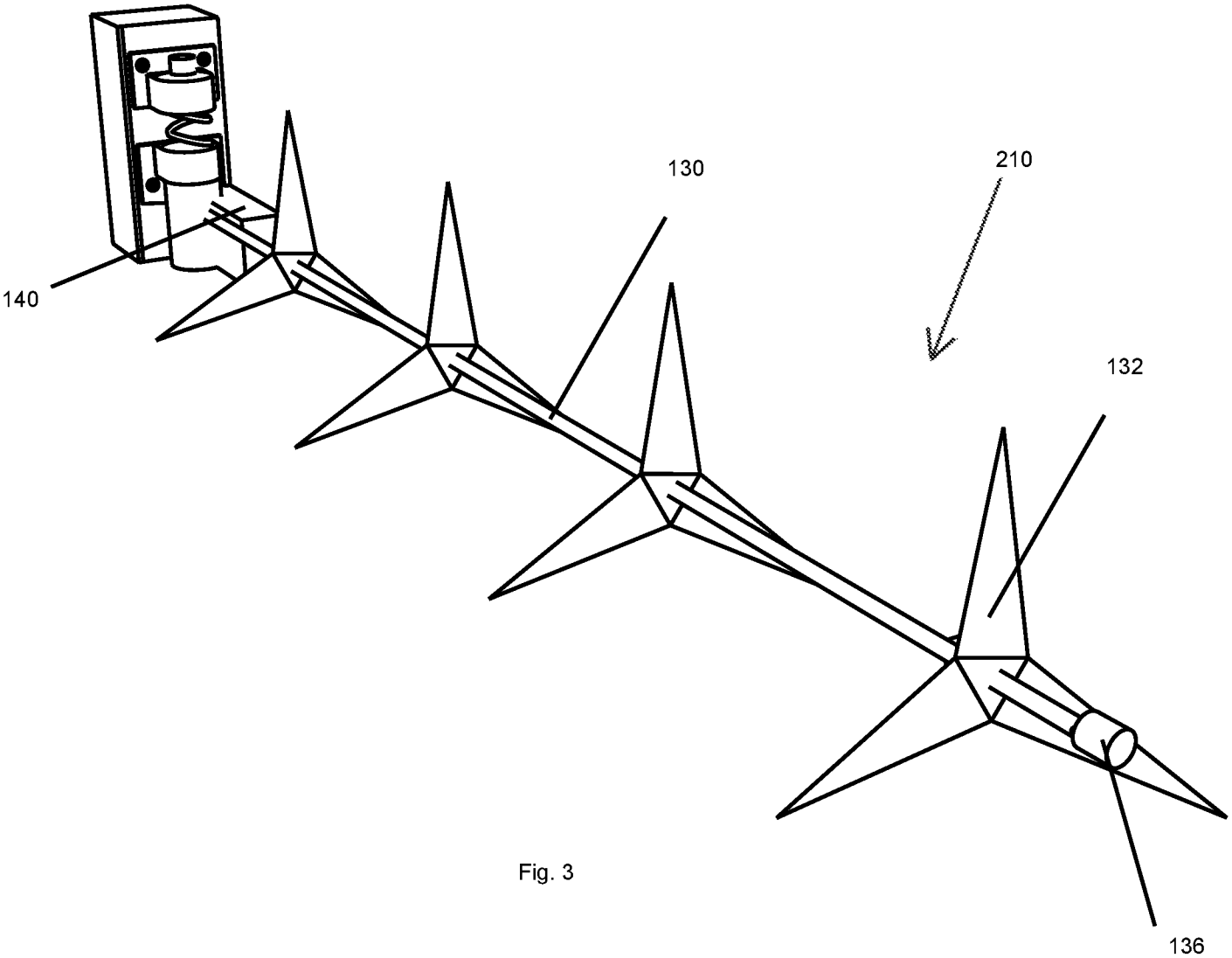
FIG. 3 is a perspective view of another embodiment of a caltrop bar and hinge mechanism for the vehicle stopping device of the present disclosure.
Figure 4:
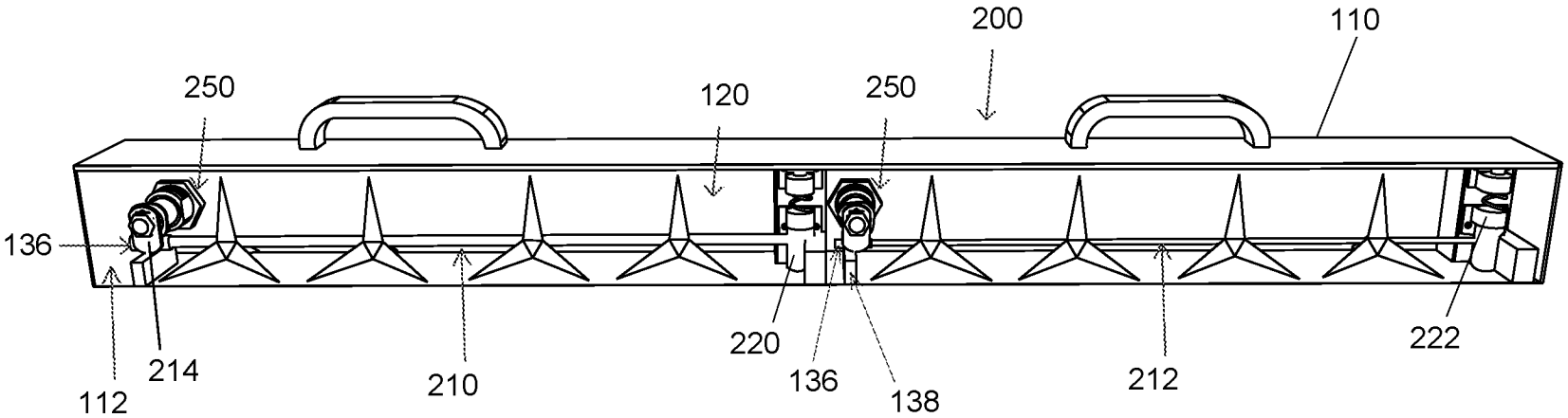
FIG. 4 is a front elevational view of a vehicle stopping device according to a second embodiment of the present disclosure, showing the caltrop bars in a stored (locked) position.
Figure 5:
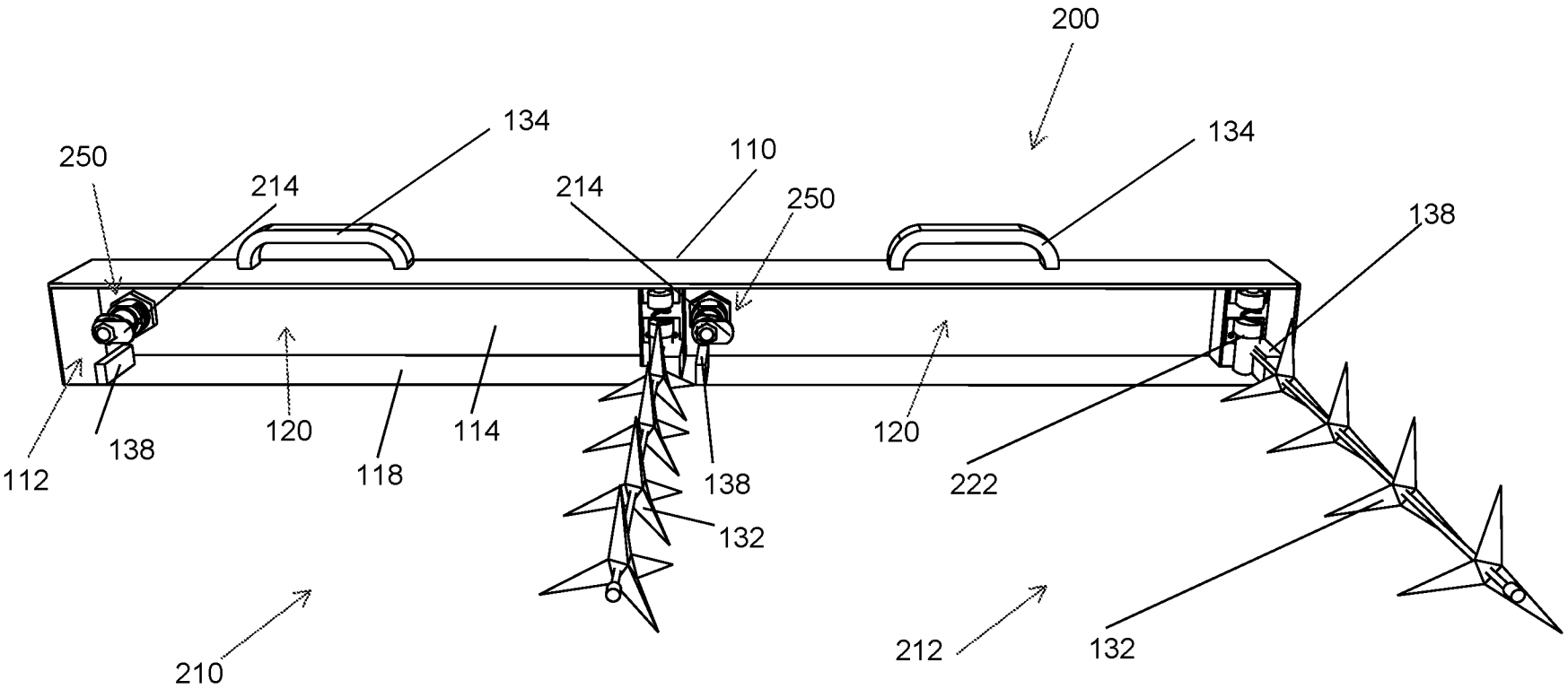
FIG. 5 is a view similar to FIG. 4 but showing the caltrop bars in a deployed (open) position.

Vehicle stopping device 200 differs from vehicle stopping device 100 in that it includes hinge mechanism 220, 222 instead of hinge mechanisms 122, 124 as described above for the embodiment of FIGS. 1-2. Hinge mechanisms 220, 222 are mounted in interior space 120 of casing 110 and are connected to caltrop bars 210, 212, respectively, as shown in FIGS. 4-5. In this embodiment, each hinge mechanism 220, 222 is a sprung hinge configured to bias the respective caltrop bar 210, 212 from the stored position (FIG. 4) towards the deployed position (FIG. 5). FIG. 3 is a close-up view of the constructional arrangement between caltrop bar 210 and hinge mechanism 220, including stop block 140 as described above for the embodiment of FIGS. 1-2. Caltrop bar 212 and hinge mechanism 222 have a similar constructional arrangement. Each hinge mechanism 220, 222 constitutes biasing means for biasing caltrop bars 210, 212 towards the deployed position.

Figure 6:
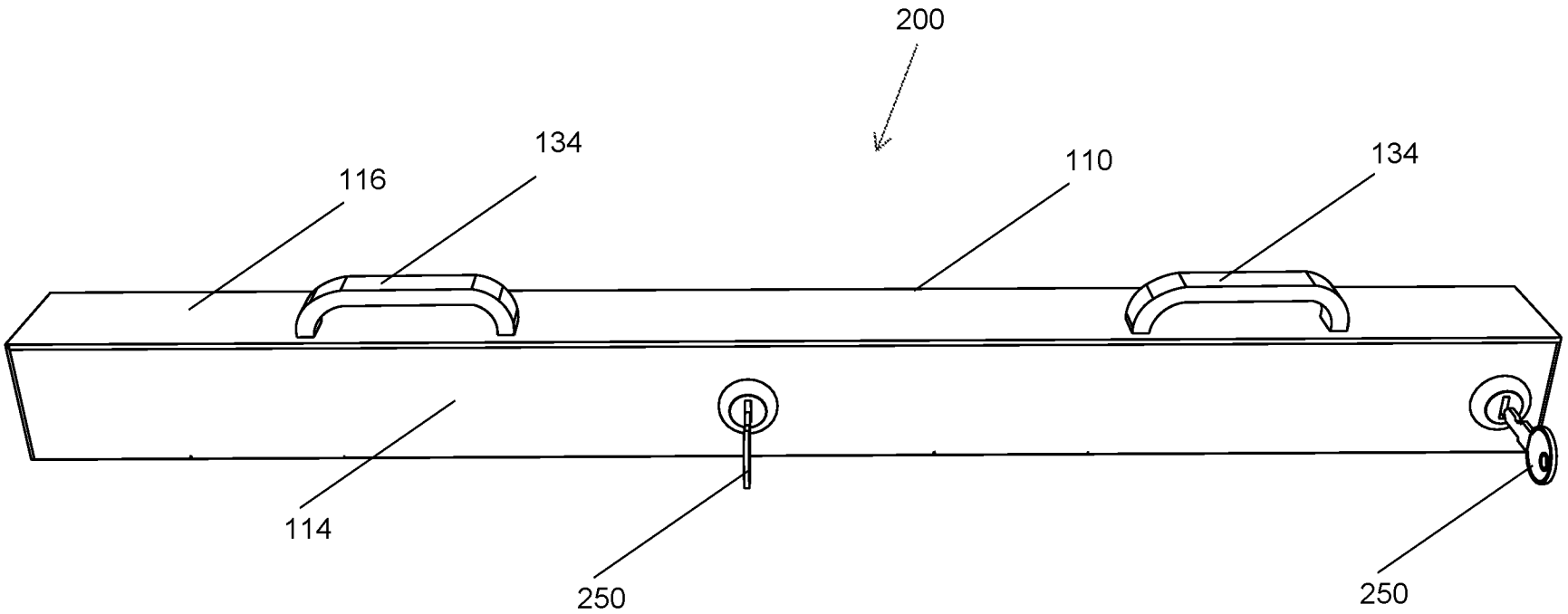
FIG. 6 is a rear view of the vehicle stopping device shown in FIG. 4.
Figure 7:
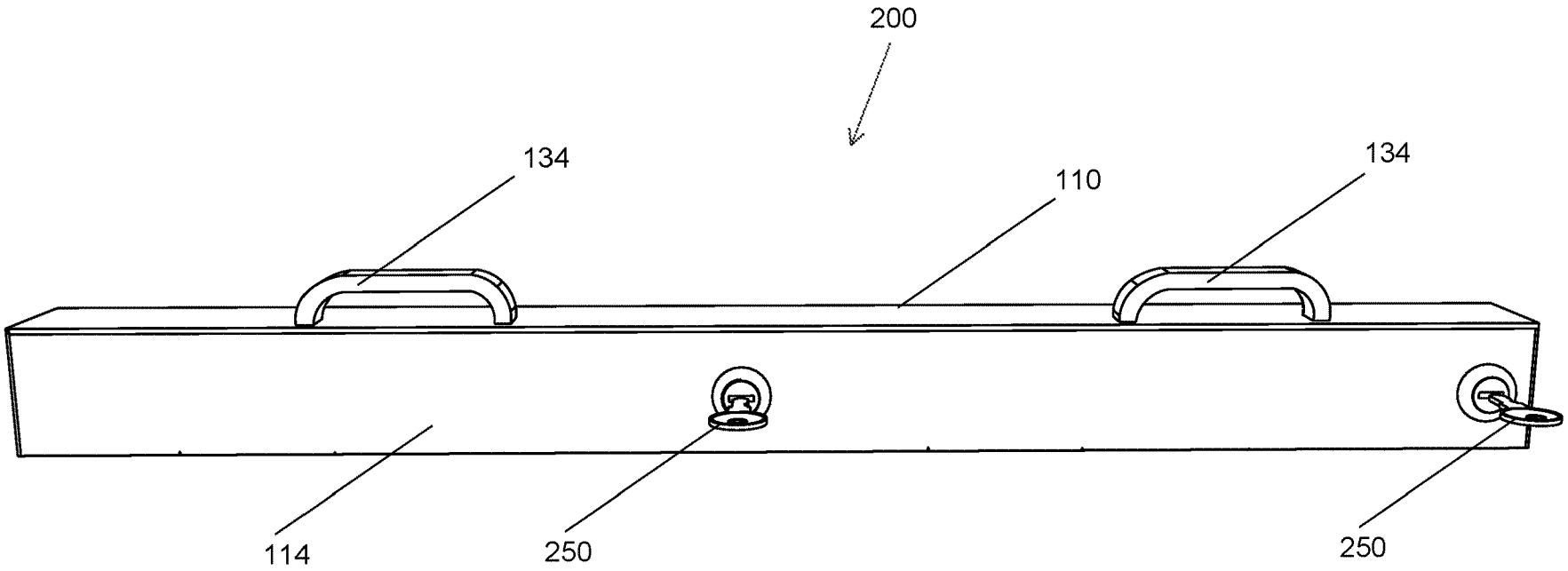
FIG. 7 is a rear view of the vehicle stopping device shown in FIG. 5.
Figure 8:
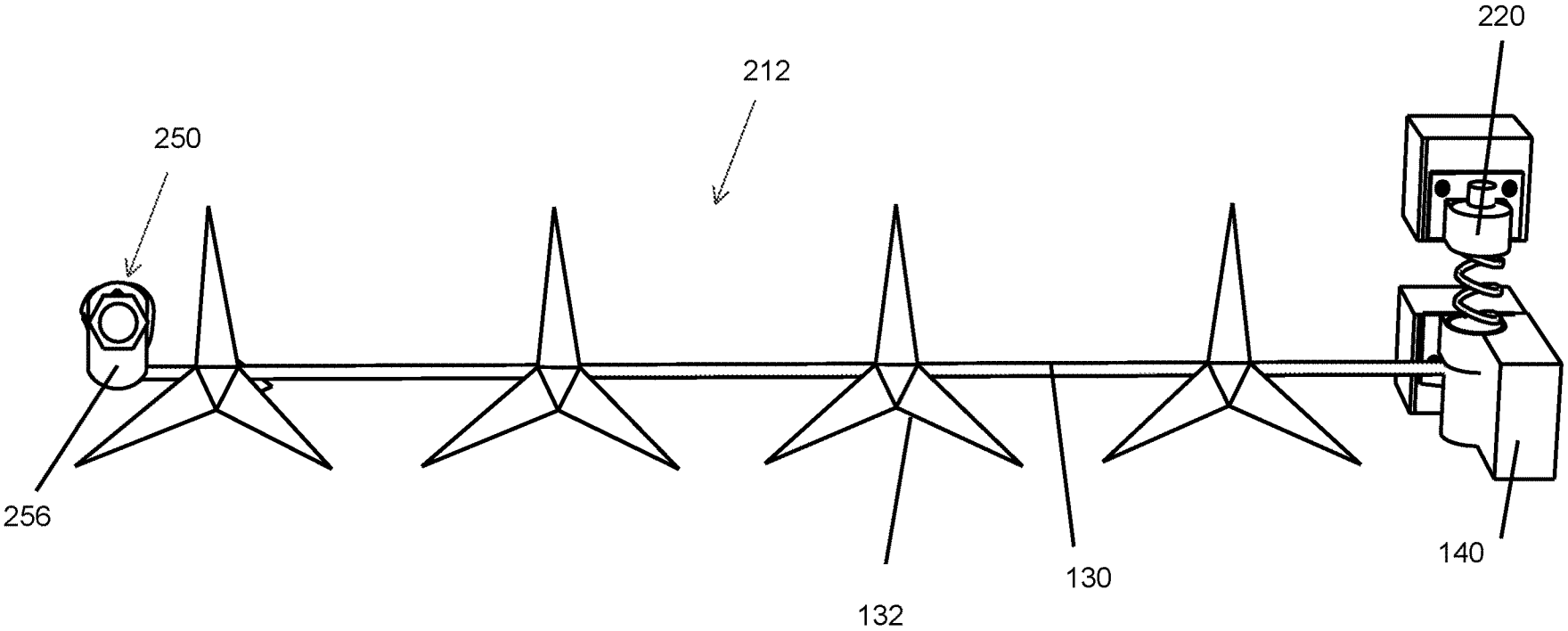
FIG. 8 is a side view of one of the caltrop bars and corresponding hinge mechanism show in in FIG. 4 while in the locked position.
Figure 9:
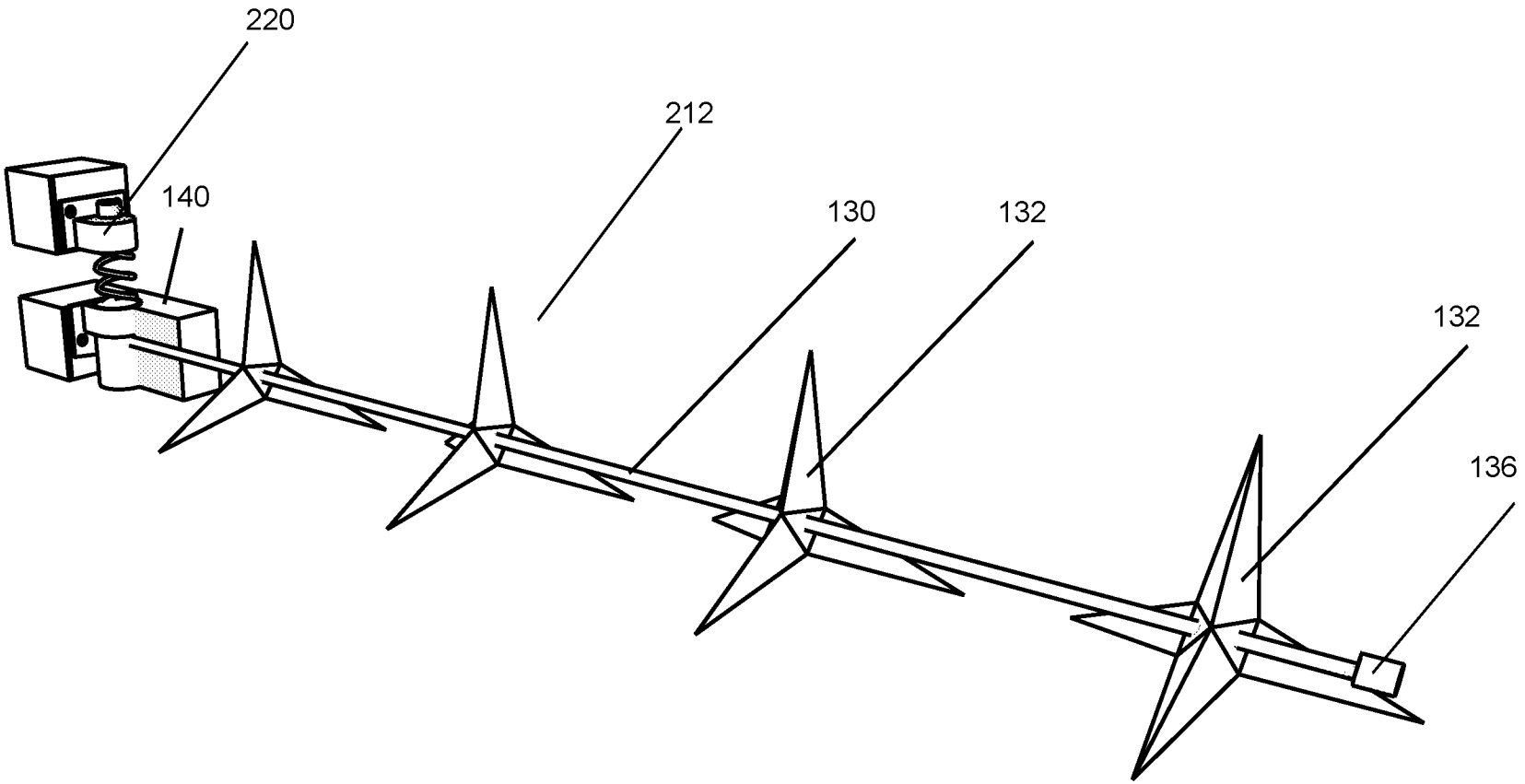
FIG. 9 is a perspective view of the caltrop bar in FIG. 8 while in the open position.

Each of the caltrop bars 210, 212 is associated with a lock and release mechanism 250 as shown in FIGS. 4-8 and 10. In a locked position, as shown in FIGS. 4, 6 and 8, lock and release mechanisms 250 are configured to retain caltrop bars 210, 212 in a tensioned state within the stored position. In an unlocked position, as shown in FIGS. 5, 7 and 9, lock and release mechanisms 250 are configured to allow caltrop bars 210, 212 to be released to the deployed position. Each of lock and release mechanisms 250 constitute means for locking the corresponding caltrop bar in the stored position against the bias of the corresponding hinge mechanism and for releasing the caltrop bar from the stored position to the deployed position under the bias of the corresponding hinge mechanism.

Figure 10:
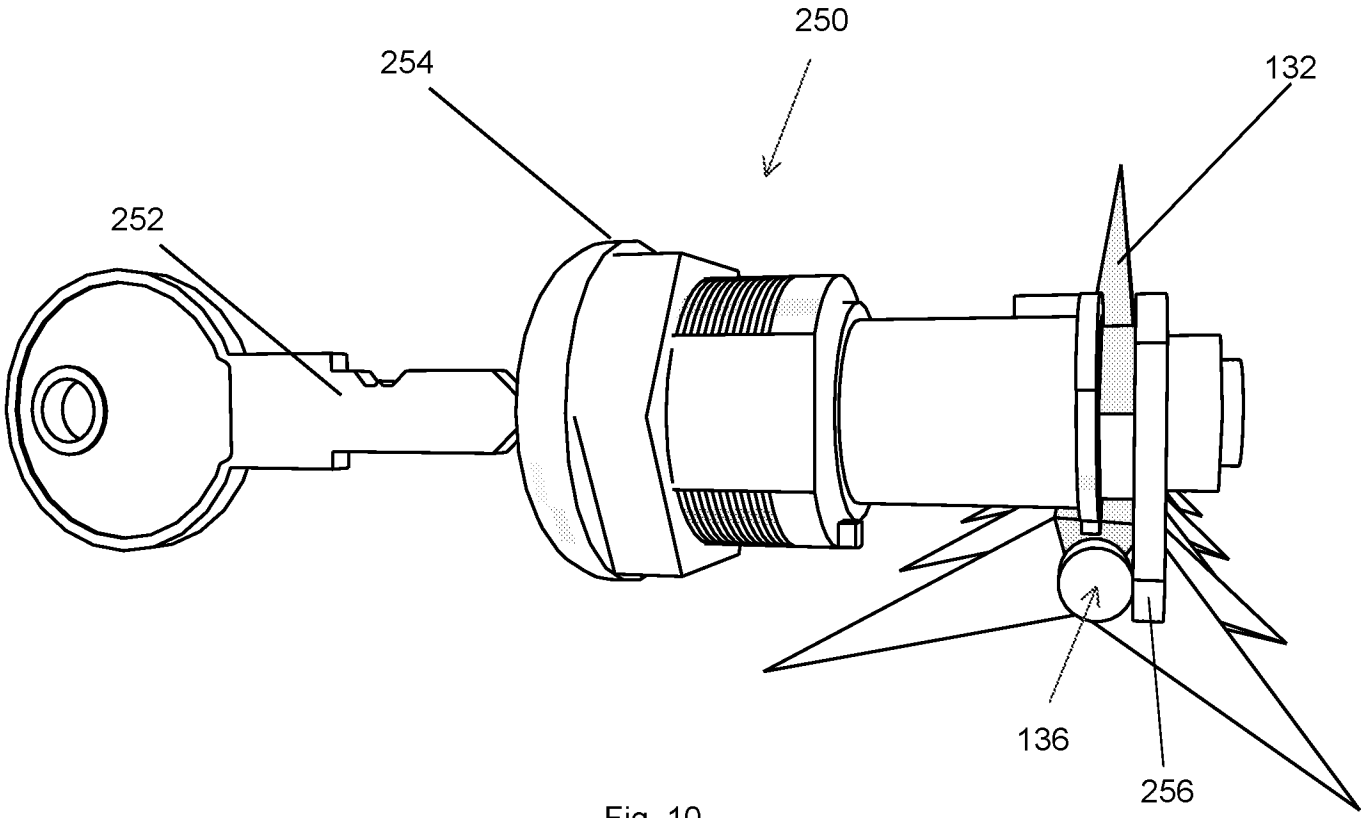
FIG. 10 is a front elevational view of a lock mechanism used in the vehicle stopping device shown in FIGS. 4-7.

Referring to FIG. 10, each lock and release mechanism 250 includes a lock element 254 containing a cam lock 256 configured for engagement with (e.g., hook over) end stop 136 of the caltrop bar in the stored position of the caltrop bar (see also FIGS. 4 and 8). Lock and release mechanism 250 also includes a key 252 for engagement with lock element 254 to activate (i.e., turn) cam lock between the locked position (FIG. 4) and the unlocked position (FIG. 5) of lock and release mechanism 250.

Thus, for each of caltrop bars 210, 212, cam lock 256 is configured to be placed in a locked position in which cam lock 256 hooks over end stop 136 of the caltrop bar at the free end thereof so that the caltrop bar is maintained in the stored position (FIG. 4). Cam locks 256 are also configured to be unlocked (i.e., the cam lock does not hook over end stop 136) to automatically release the caltrop bars to the deployed position.

It will be appreciated from the foregoing description that the lock and release mechanism 250 is configured to effectively release caltrop bars 210, 212 from the stored position to the deployed position. As described above, hinge mechanisms 220, 222 are configured to bias the respective caltrop bars 210, 212 towards the deployed position. Upon activation of the lock and release mechanism 250, caltrop bars 210, 212 are automatically released from the stored position (FIG. 4) to the deployed position (FIG. 5), as described above.

Figure 11:
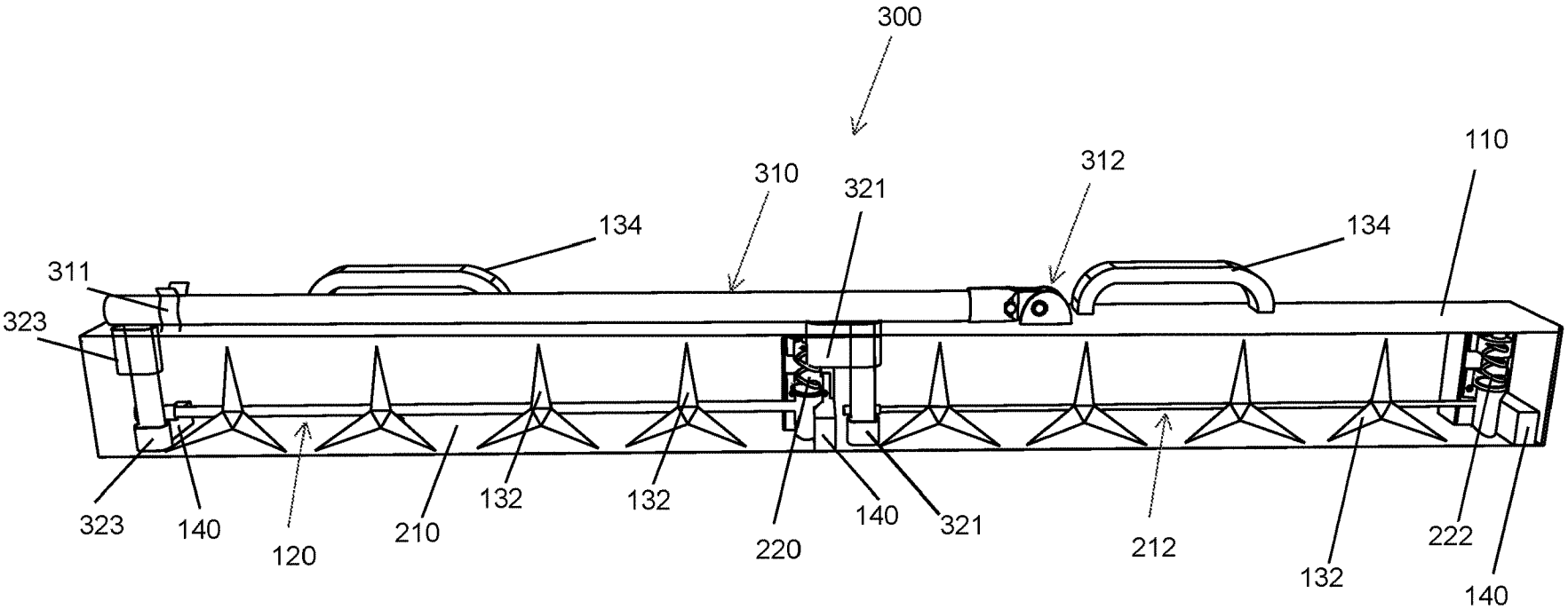
FIG. 11 is a front elevational view of a vehicle stopping device according to another embodiment of the present disclosure.
Figure 12:
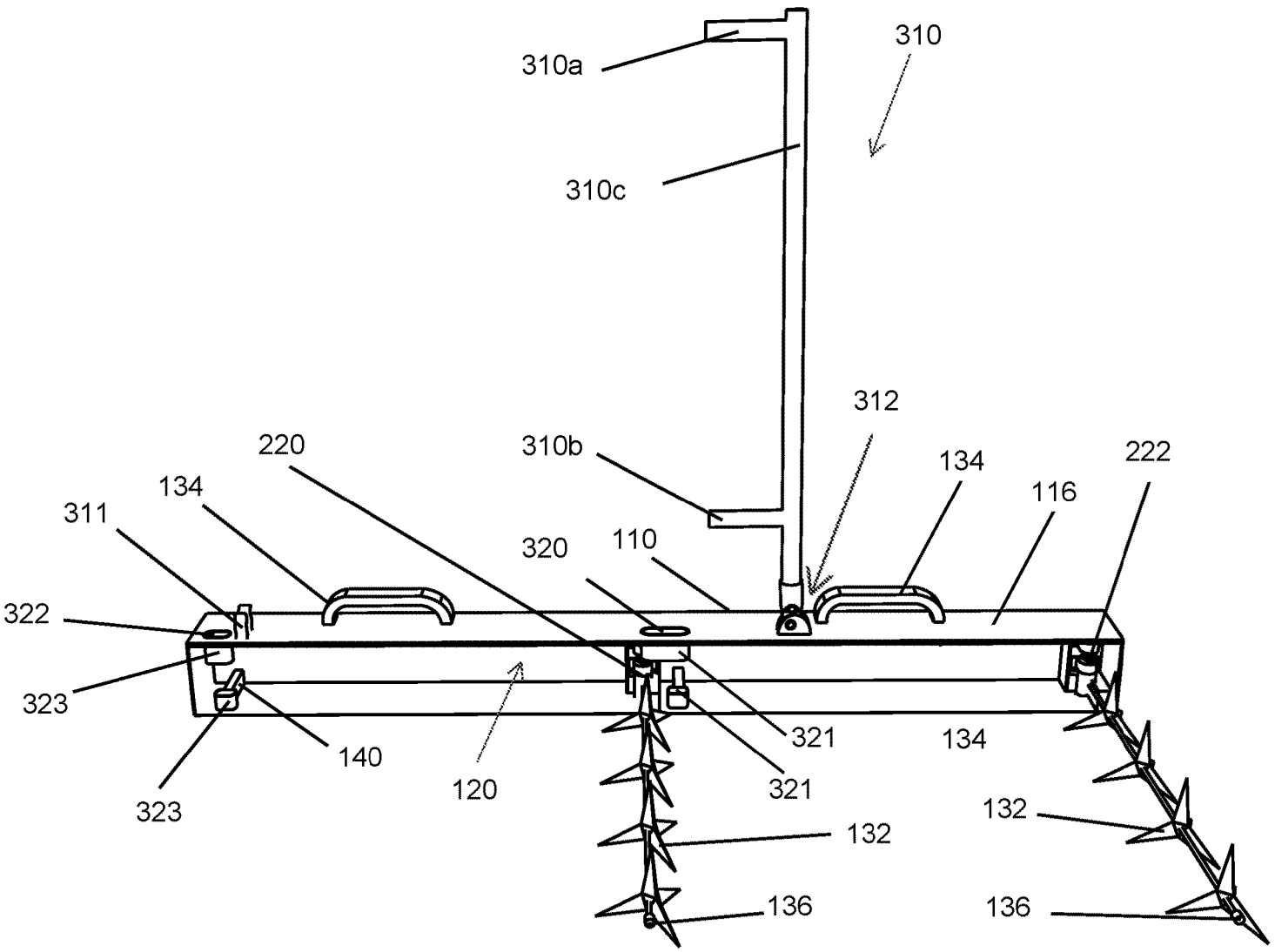
FIG. 12 is a front elevational, partial perspective view of the vehicle stopping device shown in FIG. 11, with a locking device shown in an unlocked position and caltrop bars shown in open positions.

FIGS. 11 and 12 show another embodiment of a vehicle stopping device, generally designated at 300, according to the present disclosure. The embodiment of FIGS. 11-12 has the same construction as described above for the embodiment of FIGS. 3-10, except in the construction and arrangement of the lock and release mechanism for releasing caltrop bars 210, 212 from the stored position (FIG. 11) to the deployed position (FIG. 12).

As shown in FIGS. 11-12, the lock and release mechanism in this embodiment comprises an elongate member, generally designated at 310, having a main portion 310*c* and two bar portions 310*a*, 310*b* extending from main portion 310*c* in spaced-apart relation from one another. Elongate member 310 is configured to be placed in a locked position in which bar portions 310*a*, 310*b* are configured to extend through respective slots 322, 320 formed in horizontal top wall 116 of casing 110 and into respective pairs of aligned receptacles 323, 321 positioned in interior space 120 of casing 110 to securely hold caltrop bars 210, 212 in the stored position (FIG. 11). Elongate member 310 is also configured to be unlocked by removing bar portions 310*a*, 310*b* from aligned receptacles 323, 321 and out of the interior space of casing 110 to automatically release caltrop bars 210, 212 to the deployed position (FIG. 12).

In an exemplary embodiment, elongate member 310 may be a police night stick style device that is connected to casing 110 via a quick release pin and slot connector, generally designated at 312, so that device 310 may be readily disconnected from casing 110 by the user (e.g., law enforcement personnel) for self-defense and to maintain order as needed.

Figure 13:
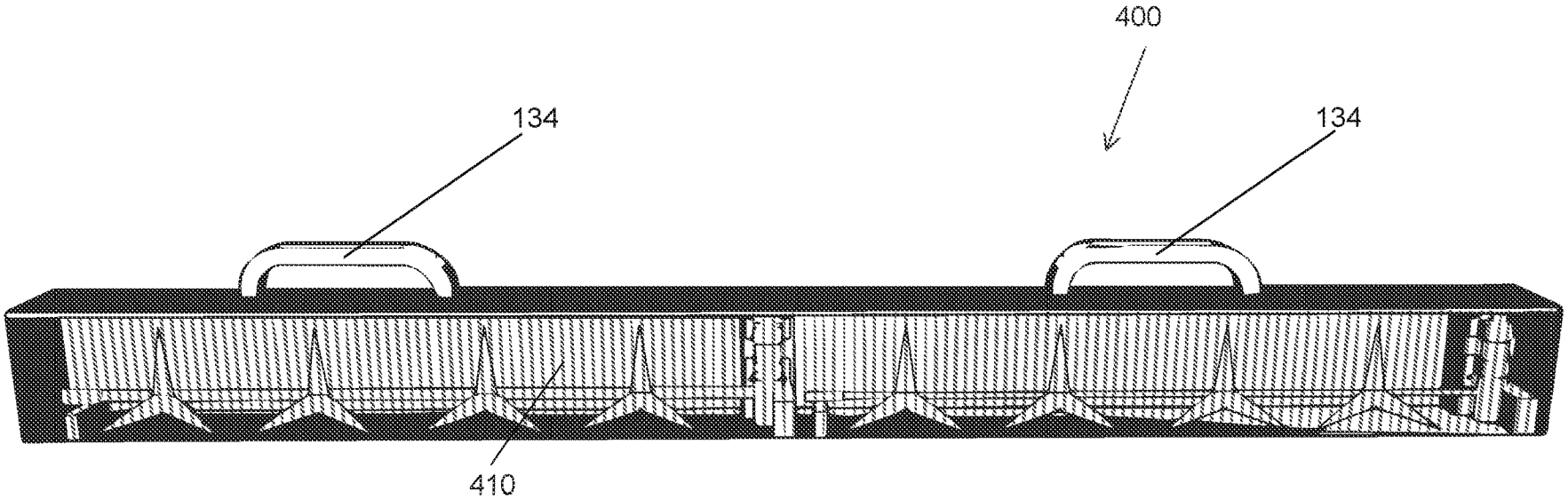
FIG. 13 is a front elevational view of a vehicle stopping device according to another embodiment of the present disclosure.
Figure 14:
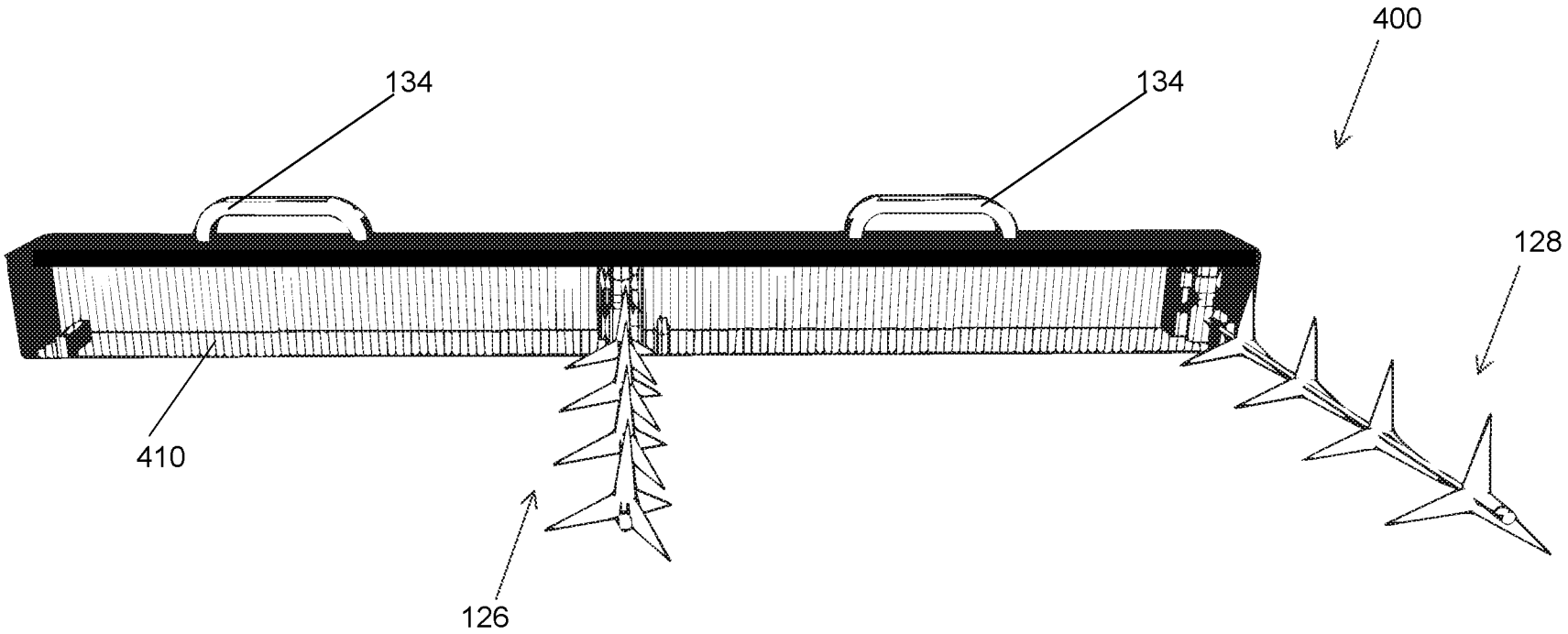
FIG. 14 is a view similar to FIG. 13, but with caltrop bars shown in the open position.
Figure 15:
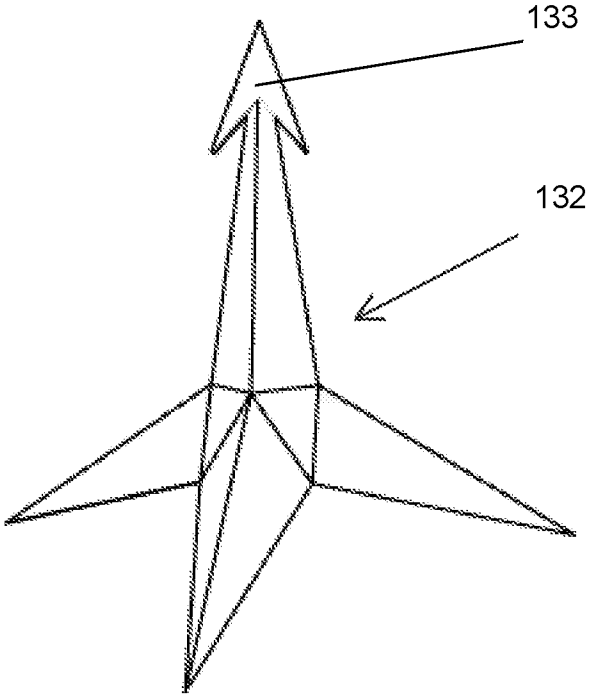
FIG. 15 is an elevational perspective view of a caltrop according to another embodiment of the present disclosure.

FIGS. 13 and 14 show another embodiment of a vehicle stopping device, generally designated at 400, according to the present disclosure. In this embodiment, vehicle stopping device 100 described above with reference to FIGS. 1-2 is further fitted with a safety cover 410 that covers open side 112 of casing 110. Safety cover 410 is configured to permit caltrop bars 126, 128 to be released to the deployed position without necessitating removal of the safety cover. To accomplish this, safety cover 410 comprises a plurality of curtain strips preferably made of a durable plastic material. In one embodiment, safety cover 410 is formed of hanging strands each connected at one end to horizontal top wall 116 in interior space 120 of housing 110, with an opposite free end of each strand hanging over horizontal bottom wall 118 of housing 110. Any suitable means may be employed for connecting the strands of safety cover 410 to horizontal top wall 116 of housing 110 so long that the strands do not impede caltrop bars 126, 128 from being quickly released to the deployed position. That is, safety cover 410 is configured and arranged relative to housing 110 to enable fast, unimpeded deployment of caltrop bars 126, 128. For example, suitable means for connecting the strands of safety cover 410 to housing 110 include plastic welding, rivets, screws, etc. without departing from the spirit and scope of the present disclosure.

While safety cover 410 is shown incorporated to vehicle stopping device 100 shown in FIGS. 1-2, it will be appreciated that safety cover 410 can also be incorporated to vehicle stopping devices 200 and 300 described above with reference to FIGS. 3-10 and 11-12, respectively.

In the foregoing embodiments, in the deployed position the caltrop bars are configured to be disposed at a preselected angle of generally 90 degrees relative to the casing. Alternatively, the caltrop bars can be configured to be deployed at preselected angles less than or greater than 90 degrees relative to the casing, depending on the position of the vehicle tire during use of the vehicle stopping device.

In the vehicle stopping device according to embodiments described above with reference to FIGS. 1-14, caltrops 132 are fixedly mounted (e.g., welded) along the bar 130. In an alternative embodiment, the caltrops 132 may be arranged along bar 130 on spaced roller bearings (not shown).

In the vehicle stopping device according to any of the foregoing embodiments, caltrop bars 132 may have a hollow construction and/or be provided with blades to facilitate and expedite the escape of compressed air and/or immobilization of the vehicle tire should the vehicle be moved while the vehicle stopping device is applied to the vehicle tire. In another embodiment, as shown in FIG. 14, caltrop bars 132 may be further provided with at least one barbell-shaped tip 133 to prevent caltrops 132 from coming out of the vehicle tire after penetrating the vehicle tire.

Figure 16:
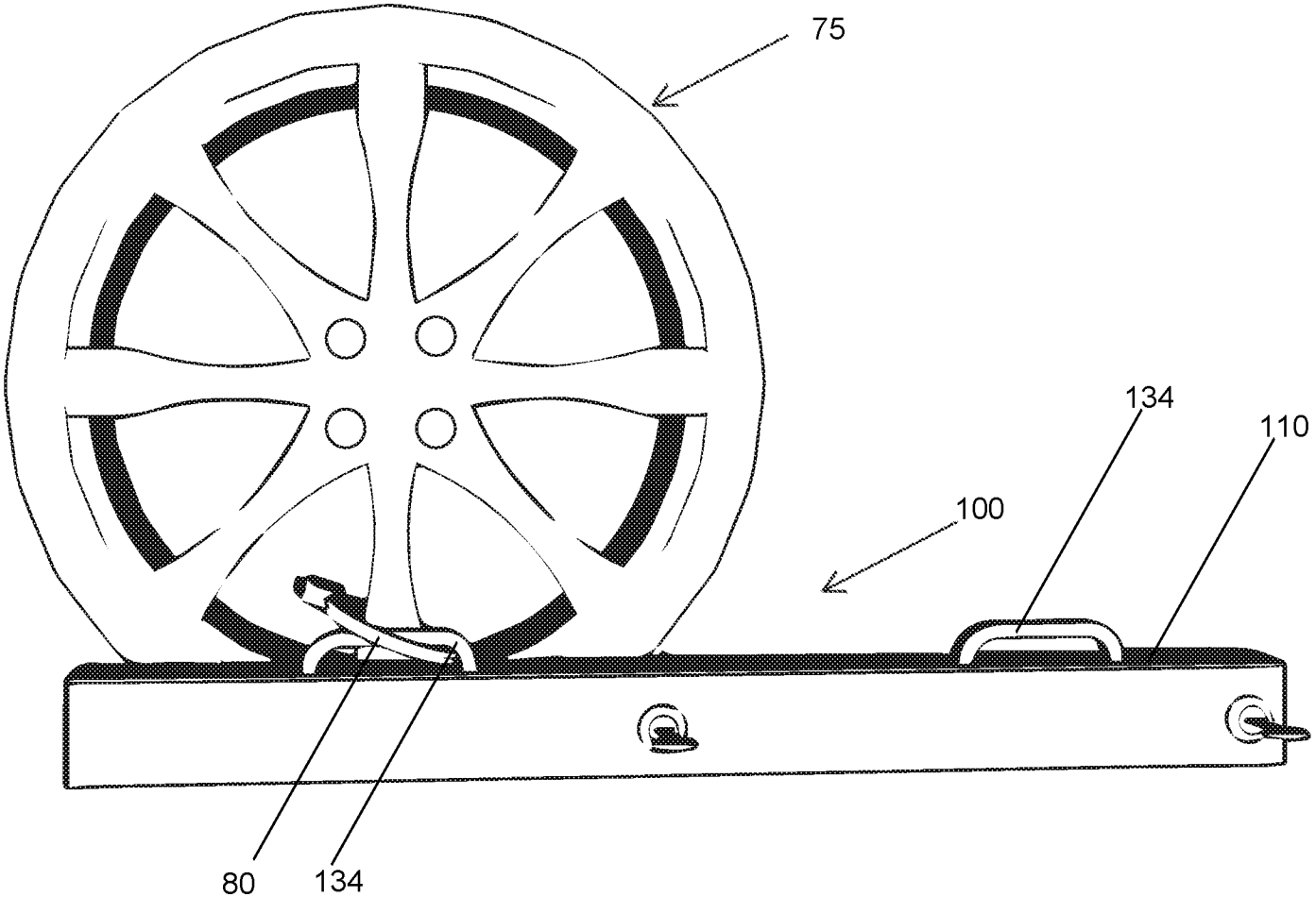
FIG. 16 is a front elevational view of the vehicle stopping device of FIG. 1 during use.
Figure 17:
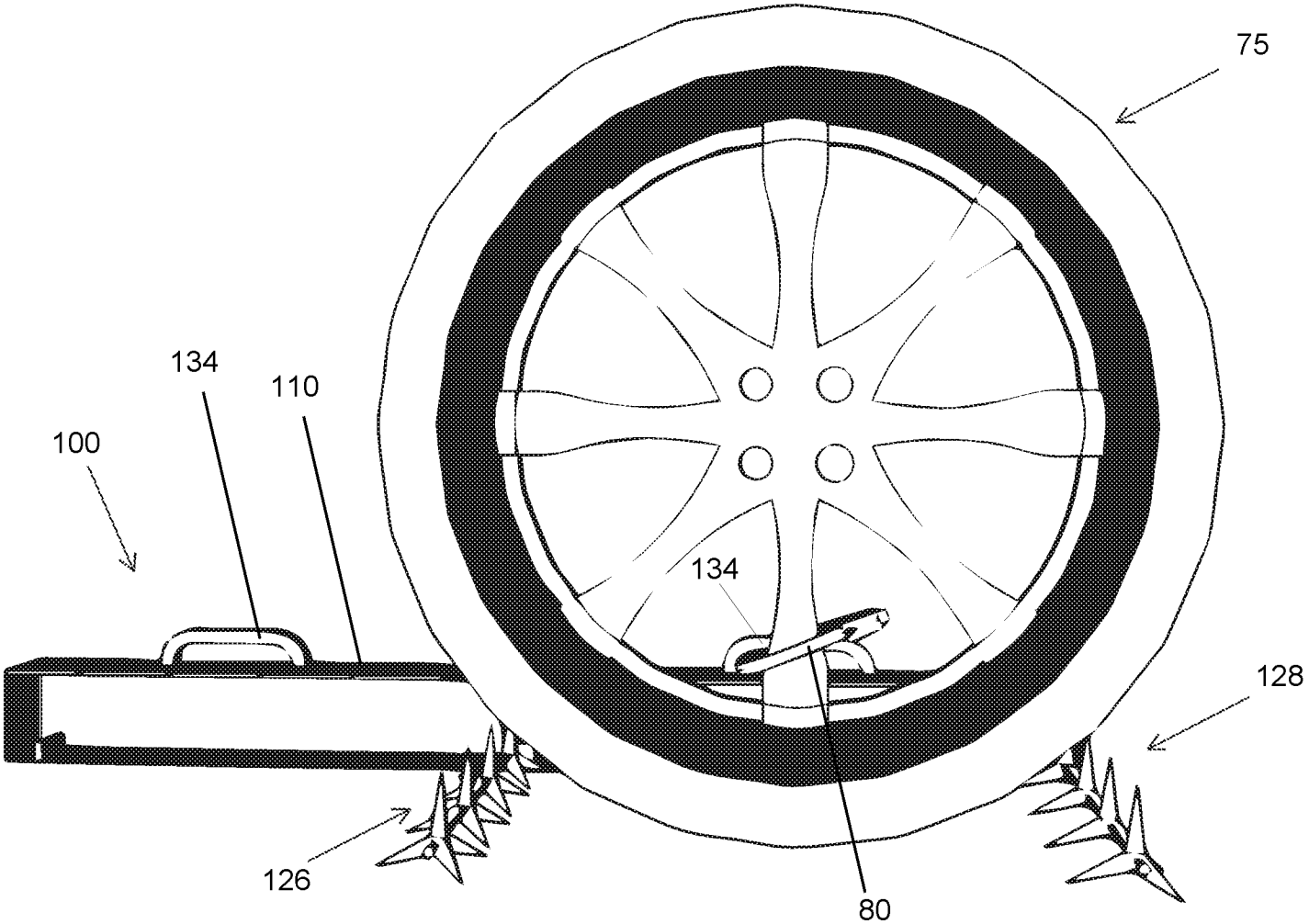
FIG. 17 is a rear view of the vehicle stopping device shown in FIG. 16.

FIG. 16 is a front elevational view of vehicle stopping device 100 in FIG. 1 during use. FIG. 17 is a rear view of vehicle stopping device 100 shown in FIG. 16. In this configuration, vehicle stopping device 100 is placed on a road surface along the width of a vehicle tire 75 as shown in FIGS. 16-17 and a lock 80 (e.g., a conventional bicycle type lock strap with combination lock) is wrapped around at least one of the handles 134 of casing 110 and around a spoke of tire 75 as shown. Caltrop bars 126, 128 are then deployed, as described above for FIGS. 1-2, so that they are disposed on opposite sides of tire 75 as shown in FIG. 17.

Figure 18:
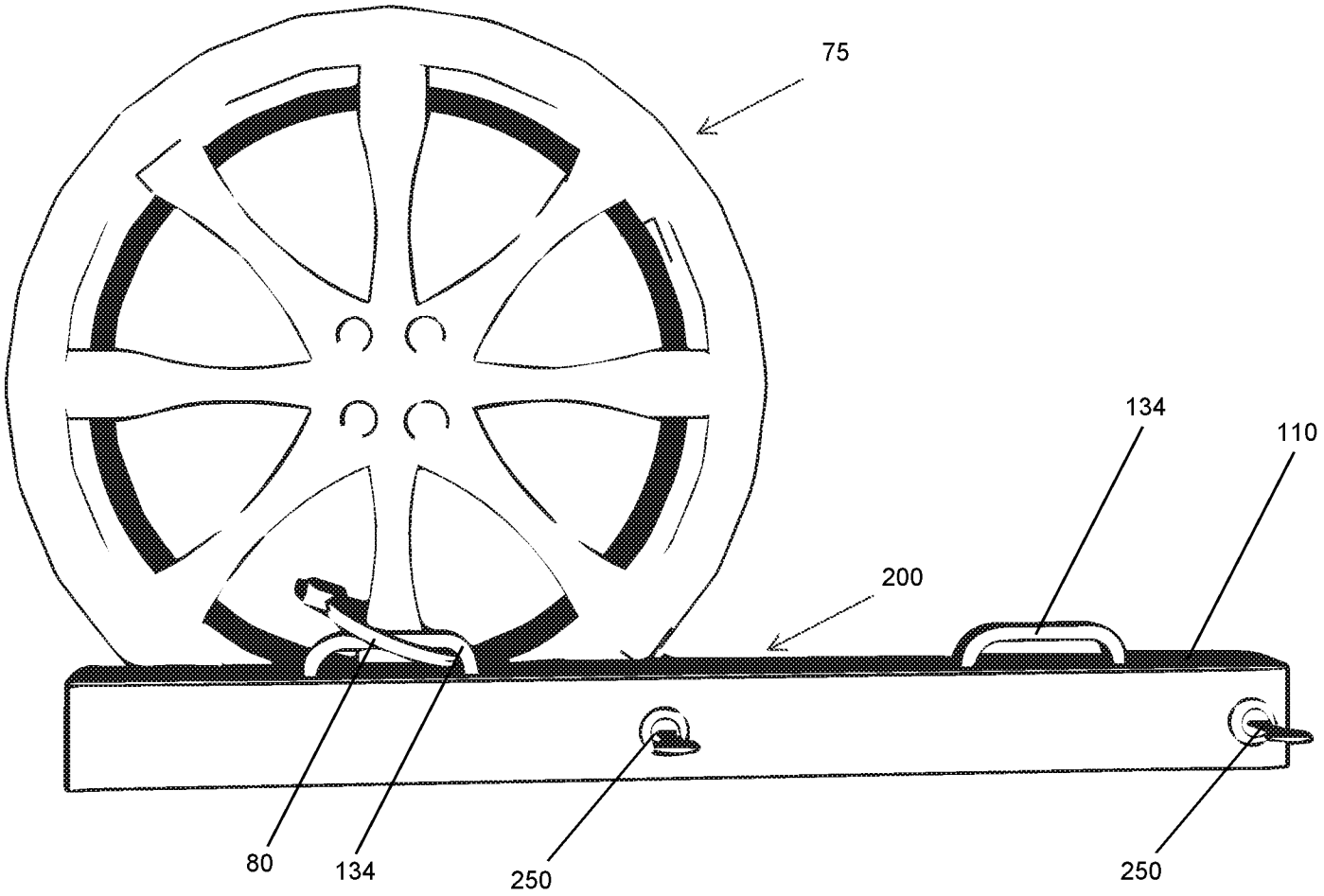
FIG. 18 is a front elevational view of the vehicle stopping device of FIGS. 4 and 5 during use.
Figure 19:
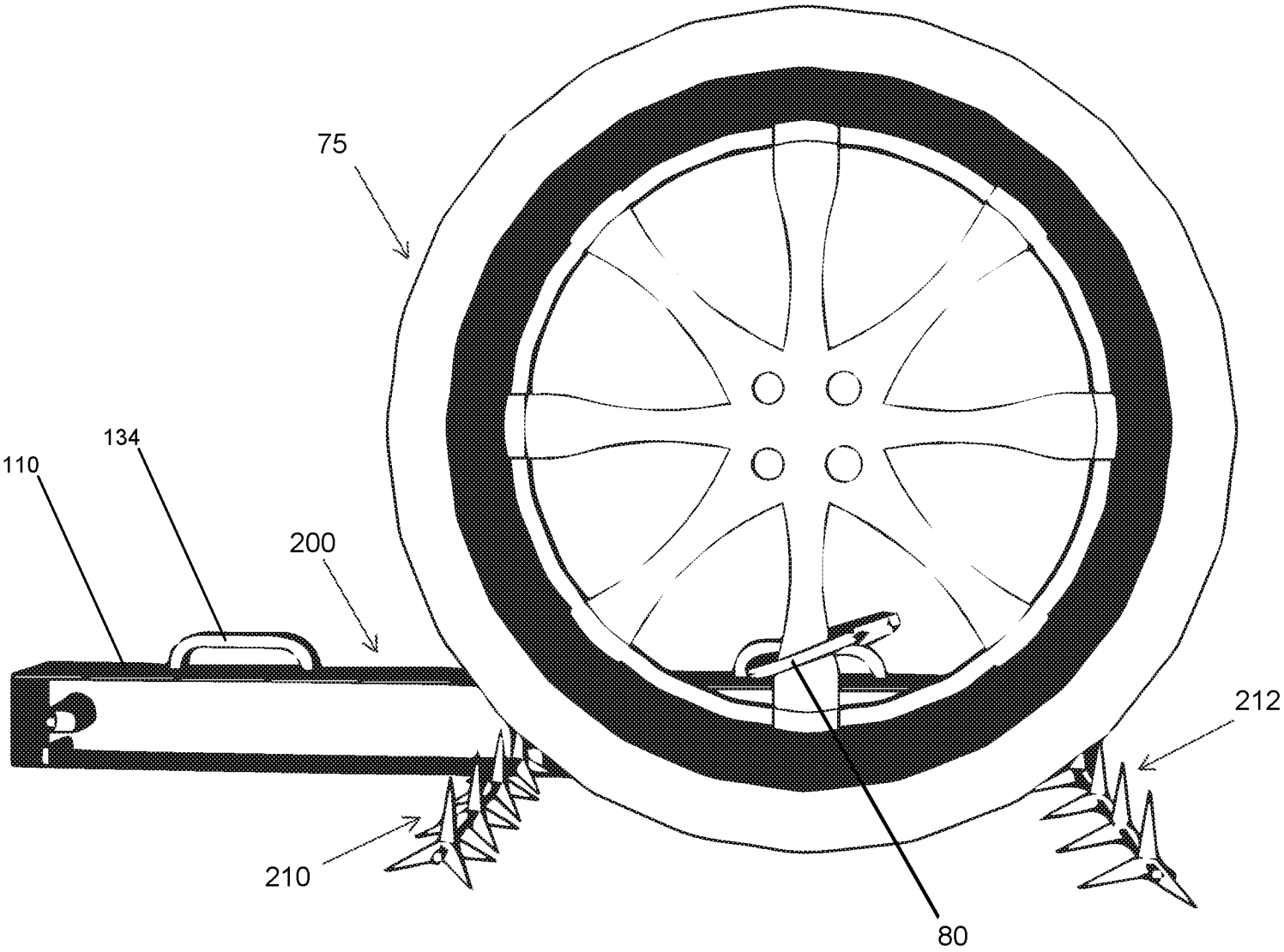
FIG. 19 is a rear view of the vehicle stopping device shown in FIG. 18.

FIG. 18 is a front elevational view of vehicle stopping device 200 of FIGS. 4-5 during use, and FIG. 19 is a rear view of vehicle stopping device 200 shown in FIG. 18. In this configuration, vehicle stopping device 200 is placed on a road surface along the width of vehicle tire 75 as shown in FIGS. 18-19 and a lock 80 is wrapped around at least one of the handles 134 of casing 110 and around a spoke of tire 75, as described above for FIGS. 16-17. Caltrop bars 210, 212 are then deployed, as described above for FIGS. 4-5, so that they are disposed on opposite sides of tire 75 as shown in FIG. 19.

Figure 20:
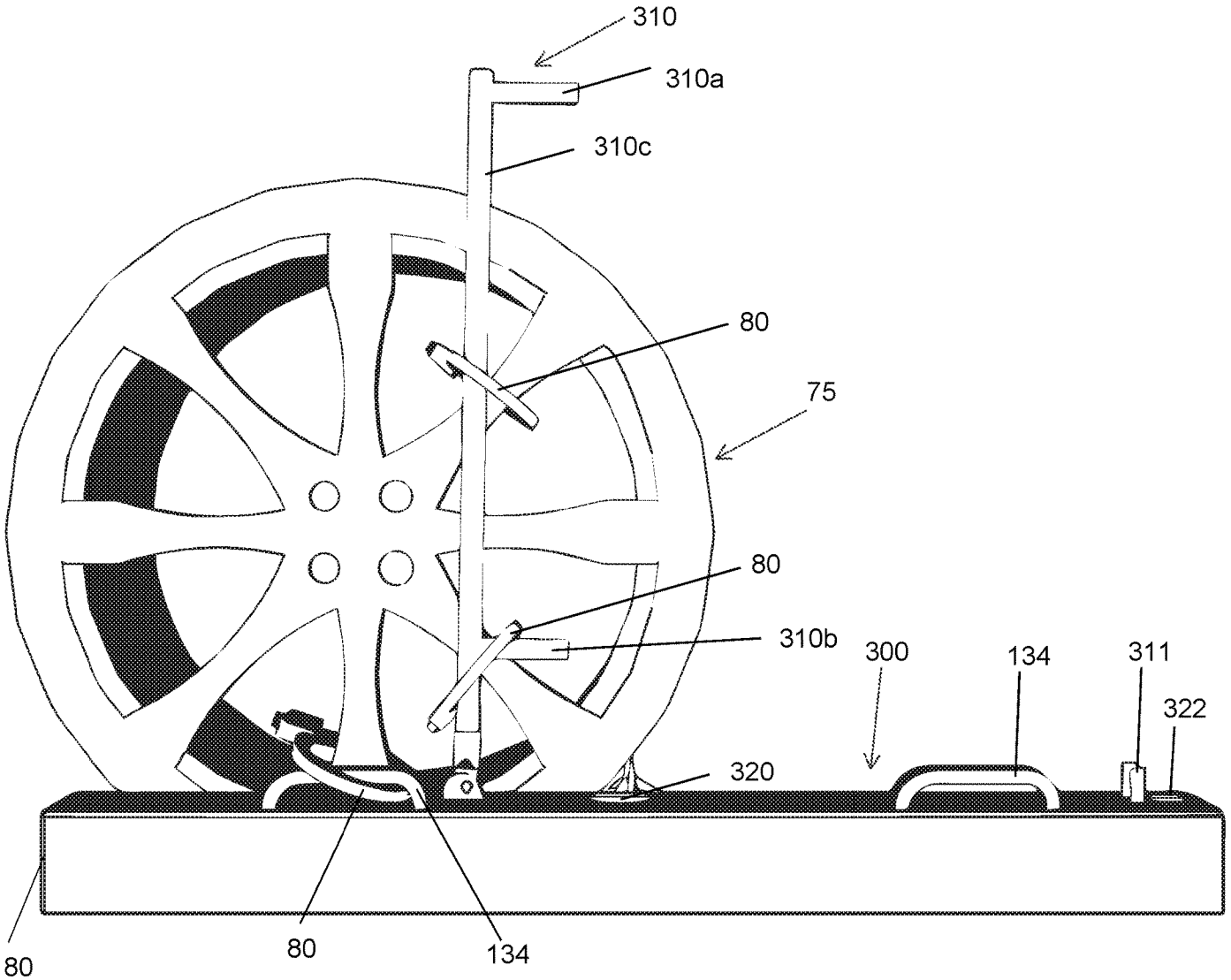
FIG. 20 is a front elevational view of the vehicle stopping device of FIGS. 11 and 12 during use.
Figure 21:
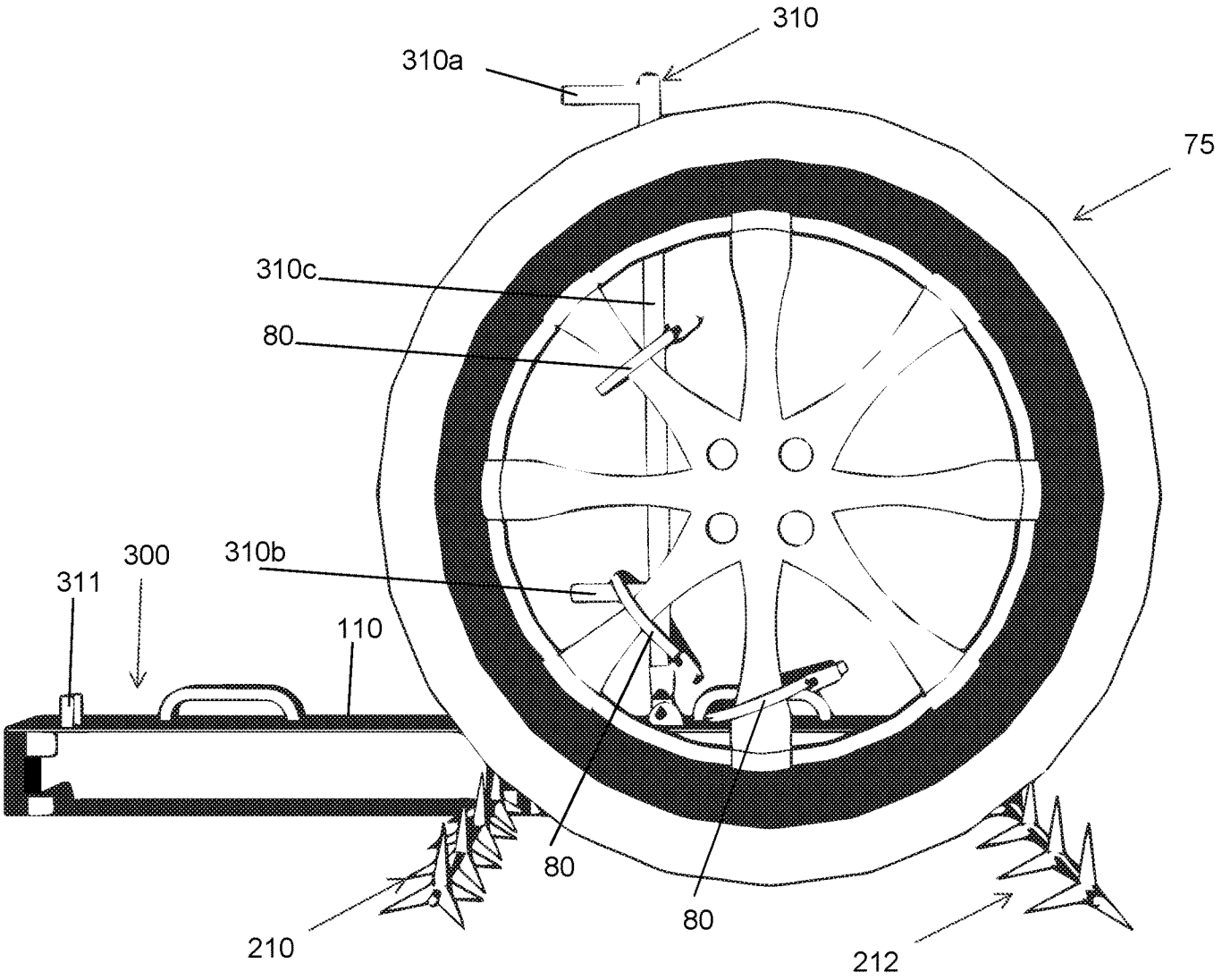
FIG. 21 is a rear view of the vehicle stopping device shown in FIG. 20.

FIG. 20 is a front elevational view of vehicle stopping device 300 of FIGS. 11-12, and FIG. 21 is a rear view of vehicle stopping device 300 shown in FIG. 20. In this configuration, vehicle stopping device 300 is placed on a road surface along the width of vehicle tire 75 as shown in FIGS. 20-21. Elongate member 310 is then deployed from the horizontal position shown in FIG. 11 to a vertical position as shown in FIGS. 12 and 20-21. Multiple locks 80 are then used to secure vehicle stopping device 300 and elongate member 310 to the tire 75. In the exemplary embodiment of FIGS. 20-21, one lock 80 is used to secure one of the handles 134 of casing 110 to a spoke of tire 75 and two additional locks 80 are used to secure elongate member 310 to spokes of tire 75 as shown in FIGS. 20-21. Caltrop bars 210, 212 are then deployed, as described above for FIGS. 11-12, so that they are disposed on opposite sides of tire 75 as shown in FIG. 21.

The vehicle stopping device according to the foregoing embodiments of the present disclosure have been described herein as being configured with two caltrop bars. It will be appreciated that the vehicle stopping device according to any of the foregoing embodiments described herein can also be configured with only one caltrop bar without departing from the spirit and scope of the present disclosure.

The vehicle stopping device according to the foregoing embodiments of the present disclosure can be easily and rapidly deployed relative to a vehicle tire and removed therefrom after use. Whilst the vehicle is stationary it can be immobilized quickly and easily with almost no risk to an officer's life and limb and in such a way as once deployed there will now be almost no chance of a high-speed pursuit. The vehicle stopping device is designed to be deployed by a single operator in a matter of seconds. The embodiments shown in FIGS. 11-12 and 20-21, in particular, provide a multiple use vehicle stopping device allowing law enforcement to get multiple usages out of a single device, and therefore reducing the effective cost of the device to law enforcement.

The vehicle stopping devices according to the present disclosure are of the type employed by law enforcement to incentivize a driver of a vehicle to comply with law enforcement instructions and not attempt to flee. The devices of the present disclosure are configured to immobilize the vehicle in situations where drivers attempt to flee. As a result, the vehicle stopping devices of the present disclosure effectively act as devices to deter vehicle drivers from fleeing law enforcement.

In addition to its effectiveness in deterring vehicle drivers from fleeing law enforcement, it will be appreciated that each of the vehicle stopping devices according to the foregoing embodiments of the present disclosure can also be effectively used as a vehicular anti-theft tire puncturing device.

The previous description of the disclosed exemplary embodiments is provided to enable any person skilled in the art to make or use the present disclosure. Various modifications to these exemplary embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A vehicle stopping device comprising:

a casing configured as an open enclosure having an open side, vertical side walls, a horizontal top wall and a horizontal bottom wall forming an interior space of the open enclosure;

a pair of caltrop bars configured to be securely stored within the interior space of the casing in a stored position, and configured to be activated from the stored position to a deployed position in which the first and second caltrop bars extend out of the interior space of the casing through the open side thereof for positioning on opposite sides of a vehicle tire, each of the caltrop bars being formed of a bar and one or more caltrops arranged along the bar for puncturing and deflating the vehicle tire when the vehicle tire is driven over the caltrop bars;

a pair of hinge mechanisms configured to permit the respective caltrop bars to be displaced from the stored position to the deployed position, the pair of hinge mechanisms being securely positioned within the interior space of the casing and connected to the respective pair of caltrop bars for activating the caltrop bars from the stored position to the deployed position, the caltrop bars having a first end connected to the respective hinge mechanisms and a second free end; and a lock and release mechanism for releasing the caltrop bars from the stored position to the deployed position under a bias action of the hinge mechanisms;

wherein for each of the caltrop bars, the lock and release mechanism comprises a cam lock configured to be placed in a locked position in which the cam lock hooks over a portion of the caltrop bar at the free end thereof so that the caltrop bar is maintained in the stored position, and configured to be placed in an unlocked position in which the cam lock does not hook over the portion of the caltrop bar so as to automatically release the caltrop bar to the deployed position.

2. The vehicle stopping device according to claim 1, wherein the caltrop bars are configured to be deployed at preselected angles less than or greater than 90 degrees relative to the casing.

3. The vehicle stopping device according to claim 1, wherein for each of the caltrop bars, the lock and release mechanism is configured in a locked position thereof to retain the caltrop bar in a tensioned state within the stored position and is configured in an unlocked position thereof to allow the caltrop bar to be released to the deployed position.

4. A vehicle stopping device comprising:

a casing configured as an open enclosure having an open side, vertical side walls, a horizontal top wall and a horizontal bottom wall forming an interior space of the open enclosure;

a pair of caltrop bars configured to be securely stored within the interior space of the casing in a stored position, and configured to be activated from the stored position to a deployed position in which the first and second caltrop bars extend out of the interior space of the casing through the open side thereof for positioning on opposite sides of a vehicle tire, each of the caltrop bars being formed of a bar and one or more caltrops arranged along the bar for puncturing and deflating the vehicle tire when the vehicle tire is driven over the caltrop bars; and a safety cover configured to cover the open side of the casing and to permit the caltrop bars to be released to the deployed position without necessitating removal of the safety cover.

5. A vehicle stopping device comprising:

a casing configured as an open enclosure having an open side, vertical side walls, a horizontal top wall and a horizontal bottom wall forming an interior space of the open enclosure;

a caltrop bar configured to be securely stored within the interior space of the casing in a stored position, and configured to be activated from the stored position to a deployed position in which the caltrop bar extends out of the interior space of the casing through the open side thereof for positioning on a desired side of a vehicle tire, the caltrop bar being formed of a bar and one or more caltrops arranged along the bar for puncturing and deflating the vehicle tire when the vehicle tire is driven over the caltrop bar;

a hinge mechanism configured to permit the caltrop bar to be displaced from the stored position to the deployed position, the hinge mechanism being securely positioned within the interior space of the casing and connected to the caltrop bar for activating the caltrop bar from the stored position to the deployed position, the caltrop bar having a first end connected to the hinge mechanism and a second free end; and a lock and release mechanism for releasing the caltrop bar from the stored position to the deployed position under a bias action of the hinge mechanism, the the lock and release mechanism comprising a cam lock configured to be placed in a locked position in which the cam lock hooks over a portion of the caltrop bar at the free end thereof so that the caltrop bar is maintained in the stored position and configured to be placed in an unlocked position in which the cam lock does not hook over the portion of the caltrop bar so as to automatically release the caltrop bar to the deployed position.

6. The vehicle stopping device according to claim 5, further comprising a safety cover configured to cover the open side of the casing and to permit the caltrop bar to be released to the deployed position without necessitating removal of the safety cover.

7. The vehicle stopping device according to claim 5, wherein the caltrop bar is configured to be deployed at preselected angles less than or greater than 90 degrees relative to the casing.

* * * * *